US009788672B2

(12) United States Patent
Domkam

(10) Patent No.: US 9,788,672 B2
(45) Date of Patent: Oct. 17, 2017

(54) RECONFIGURABLE PILLOW COVER

(71) Applicant: Isabelle Domkam, Duluth, GA (US)

(72) Inventor: Isabelle Domkam, Duluth, GA (US)

(73) Assignee: Isabelle Domkam, Duluth, GA (US)

( * ) Notice: Subject to any disclaimer, the term of this patent is extended or adjusted under 35 U.S.C. 154(b) by 253 days.

(21) Appl. No.: 14/817,926

(22) Filed: Aug. 4, 2015

(65) Prior Publication Data

US 2017/0035224 A1 Feb. 9, 2017

(51) Int. Cl.
*A47G 9/02* (2006.01)

(52) U.S. Cl.
CPC ..... *A47G 9/0253* (2013.01)

(58) Field of Classification Search
CPC ..... A47G 9/10; A47G 9/0238; A47G 9/0253; A45C 13/08; A47D 15/02
USPC ..... 5/490
See application file for complete search history.

(56) References Cited

U.S. PATENT DOCUMENTS 4,873,736 A * 10/1989 Sapp ..... A47G 9/10 5/490
5,157,799 A * 10/1992 Aird ..... A47G 9/0253 5/490
5,652,983 A * 8/1997 Kraemer ..... A47G 9/0253 5/630
5,940,909 A * 8/1999 Sapp ..... A47G 9/0253 5/482
6,367,083 B1 * 4/2002 November ..... A47G 9/064 2/69.5
6,532,611 B1 * 3/2003 Day ..... A47C 7/383 5/636
6,687,931 B1 * 2/2004 Benavides ..... A01K 1/0353 5/485
2005/0177941 A1 * 8/2005 Miller ..... A47G 9/0253 5/490
2008/0235877 A1 * 10/2008 Murray ..... A47G 9/10 5/640
2010/0200129 A1 * 8/2010 Polozzolo ..... A45C 3/08 150/105
2012/0289116 A1 * 11/2012 Beuerle ..... A47G 9/0253 446/72
2017/0020311 A1 * 1/2017 Dubois ..... A47G 9/086
2017/0042350 A1 * 2/2017 Mittal ..... A47G 9/10

* cited by examiner

*Primary Examiner* — David E Sosnowski
*Assistant Examiner* — Myles Throop
(74) *Attorney, Agent, or Firm* — Isabelle Domkam

(57) ABSTRACT

Implementations of a reconfigurable pillow cover are provided. In some implementations, the pillow cover comprises six pieces of material configured to achieve at least eight different design configurations of the pillow cover. In some implementations, the pillow cover includes a functional zipper to achieve additional design looks for the pillow cover. In some implementations, the zipper is functional when the material attached to the zipper is exposed on a first side and when the material attached to the zipper is reversed thereby exposing another side of the material. In some implementation, the pillow cover comprises two zippered openings wherein a pillow may be inserted into one of the openings and the pillow cover configurations may be changes while the pillow is inserted in the pillow opening.

7 Claims, 5 Drawing Sheets

RECONFIGURABLE PILLOW COVER

TECHNICAL FIELD

This disclosure relates to implementations of a reconfigurable pillow cover.

BACKGROUND

Reversible pillow covers exist in the prior art. For example, U.S. Pat. Nos. 3,044,517; 4,873,736; 5,557,815; and 6,687,931 disclose reversible pillow covers. However, these references do not disclose a reversible pillow cover capable of being reversed while a pillow is inserted in the cover along with the capability to remove the pillow if desired. More particularly, the existing reversible pillow covers either can only be reversed by first removing the pillow or, if the pillow can be reversed with a pillow, there is no ability to remove the pillow if desired. It may be desirable to have a reversible cover that can be reversed without removing a pillow but still has the option to remove the pillow if desired. Furthermore, existing reversible or reconfigurable pillow covers have limited, pre-set configurations that cannot be changed by the end-user.

DETAILED DESCRIPTION

Implementations of a reconfigurable pillow cover are provided. In some implementations, the pillow cover comprises six pieces of material configured to achieve at least eight different design configurations of the pillow cover. In some implementations, the pillow cover includes a functional zipper to achieve additional design looks for the pillow cover. In some implementations, the zipper is functional when the material attached to the zipper is exposed on a first side and when the material attached to the zipper is reversed thereby exposing another side of the material. In some implementation, the pillow cover comprises zippered openings wherein a pillow may be inserted into one opening and the pillow configurations may be changes while the pillow is inserted in the pillow opening.

FIGS. 1A-1D and 2A-2D illustrate example configurations of a pillow cover 100 according to the present disclosure.

Figure 3:
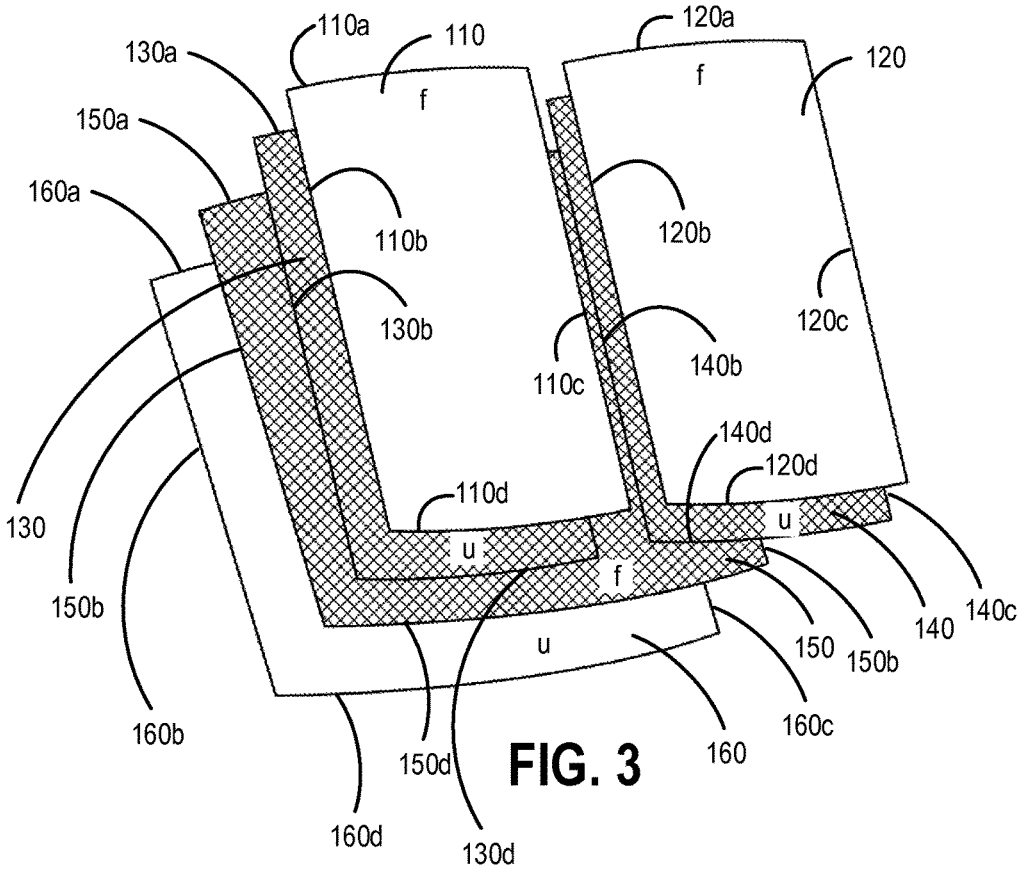
FIGS. 3 and 4 illustrates component parts of the pillow cover according to the present disclosure.

As shown in FIG. 3, in some implementations, the pillow cover 100 includes a first piece of material 110, a second piece of material 120, a third piece of material 130, a fourth piece of material 140, a fifth piece of material 150, and a sixth piece of material 160.

In some implementations, each piece of material has a first surface and second surface. In some implementations, one surface may be finished (labeled "f") and the other surface may be unfinished (labeled "u"). In some implementations, the unfinished surface may intended to not be seen. In some implementations, each finished surface has a design (e.g., color or pattern or both).

In some implementations, the design of the finished surface of the first piece of material 110 and the second piece of material 120 are the same. In some implementations, the first piece of material 110 and the second piece of material 120 are cut from the same roll or from the same piece of a larger fabric having a design.

In some implementations, the design of the finished surface (see FIG. 1C) of the third piece of material 130 and the fourth piece of material 140 are the same. In some implementations, the third piece of material 130 and the fourth piece of material 140 are cut from the same roll or from the same piece of a larger fabric having a design.

In some implementations, the design of the finished surface of the third piece of material 130 and the fourth piece of material 140 are different than the design of the finished surface of the first piece of material 110 and the second piece of material 120.

In some implementations, the design of the finished surface of the fifth piece of material 150 is different than the design of the finished surface of the first piece of material 110 and the second piece of material 120. In some implementations, the design of the finished surface of the fifth piece of material 150 is the same as the design of the finished surface of the third piece of material 130 and the fourth piece of material 140. In some implementations, the fifth piece of material 150, the third piece of material 130, and the fourth piece of material 140 may be cut from the same roll or from the same piece of a larger fabric having a design.

In some implementations, the design of the finished surface (see FIG. 1D) of the sixth piece of material 160 is the same as the design of the finished surface of the first piece of material 110 and the second piece of material 120. In some implementations, the sixth piece of material 160, the first piece of material 110, and the second piece of material 120 may be cut from the same roll or from the same piece of a larger fabric having a design.

In some implementations, each piece of material has a top side (110*a*, 120*a*, 130*a*, 140*a*, 150*a*, 160*a*), a first lateral side (110*b*, 120*b*, 130*b*, 140*b*, 150*b*, 160*b*), a second lateral side (110*c*, 120*c*, 130*c*, 140*c*, 150*c*, 160*c*) opposite the first lateral side, and a bottom side (110*d*, 120*d*, 130*d*, 140*d*, 150*d*, 160*d*).

As shown in FIG. 3, the sixth piece of material 160 defines the width and height of the pillow cover 100 as it is the largest piece. In some implementations, the sixth piece of material 160 may be rectangular in shape. In some implementations, the sixth piece of material 160 may be any suitable shape.

In some implementations, the fifth piece of material 150 is sized to attach the fifth piece of material 150 to the sixth piece of material 160 along the top side 160*a* and lateral sides 160*b* and 160*c* of the sixth piece of material 160. In some implementations, the fifth piece of material 150 and the sixth piece of material 160 are the same size or nearly the same size. In some implementations, it is intended that the the fifth piece of material 150 and the sixth piece of material 160 are coextensive with some tolerances based standard manufacturing variances.

In some implementations, the fifth piece of material 150 is sized to attach the top side 150*a* of the fifth piece of material 150 to the top side 160*a* of the sixth piece of material 160, attach a first lateral side 150*b* of the fifth piece of material 150 to the first lateral side 160*b* of the sixth piece of material 160, and attach a second lateral side 150*c* opposite the first lateral side 150*a* of the fifth piece of material 150 to the second lateral side 160*c* opposite the first lateral side 160*b* of the sixth piece of material 160.

In some implementations, the first piece of material 110 and the second piece of material 120 are smaller in width than the sixth piece of material 160 and configured such that when the first piece of material 110 and the second piece of material 120 are placed side by side the cumulative width of the two pieces of material do not exceed the width of the sixth piece of material 160.

In some implementations, the first piece of material 110 is sized to attach the top side 110*a* of the first piece of material 110 to a portion of the top side 160*a* of the sixth piece of material 160 and attach a first lateral side 110*b* of the first piece of material 110 to the first lateral side 160*b* of the sixth piece of material 160.

In some implementations, the second piece of material 120 is sized to attach the top side 120*a* of the second piece of material 120 to another portion of the top side 160*a* of the sixth piece of material 160 and attach a second lateral side 120*c* of the second piece of material 120 to the second lateral side 160*c* of the sixth piece of material 160.

In some implementations, the third piece of material 130 and the fourth piece of material 140 are smaller in width than the sixth piece of material 160 and configured such that when the third piece of material 130 and the fourth piece of material 140 are placed side by side the cumulative width of the two pieces of material do not exceed the width of the sixth piece of material 160.

In some implementations, the third piece of material 130 and the fourth piece of material 140 are the same size or nearly the same size as the first piece of material 110 and the second piece of material 120, respectively. It is intended that the first piece of material 110 and the third piece of material 130 when attached on all four sides are coextensive with some tolerances based standard manufacturing variances. Similarly, it is intended that the second piece of material 120 and the fourth piece of material 140 when attached on all four sides are coextensive with some tolerances based standard manufacturing variances.

In some implementations, the third piece of material 130 is sized to attach the top side 130*a* of the third piece of material 130 to a portion of the top side 160*a* of the sixth piece of material 160 and attach a first lateral side 130*b* of the third piece of material 130 to the first lateral side 160*b* of the sixth piece of material 160.

In some implementations, the fourth piece of material 140 is sized to attach the top side 140*a* of the fourth piece of material 140 to another portion of the top side 160*a* of the sixth piece of material 160 and attach a second lateral side 140*c* of the fourth piece of material 140 to the second lateral side 160*c* of the sixth piece of material 160.

Figure 4:
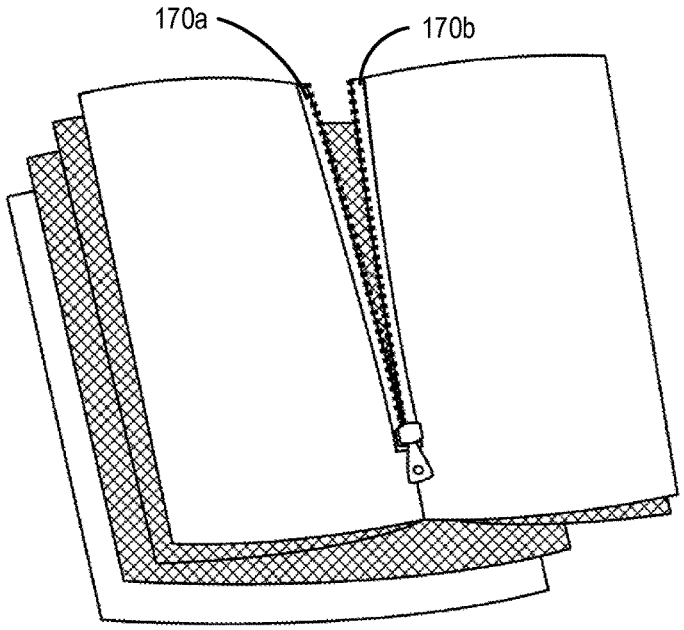

Referring to FIGS. 3 and 4, in some implementations, to construct the pillow cover 100, the first piece of material 110 is aligned on top of the third piece of material 130 with the finished surfaces of the first piece of material 110 and the third piece of material 130 facing outward.

A first side 170*a* of a first zipper 170 then is sewn along the second lateral side 110*c* of the first piece of material 110 and the second lateral side 130*c* of the third piece of material 130. In some implementations, the tape of the first side of the first zipper 170*a* is inserted between the first piece of material 110 and the third piece of material 130 along the second lateral side 110*c* of the first piece of material 110 and the second lateral side 130*c* of the third piece of material 130. In some implementations, the first side of the first zipper 170*a* does not extend all the way to the bottom 110*d*, 130*d* of the first piece of material 110 and the third piece of material 130 to, for example, provide space at the bottom of materials 110, 130, to attach the second zipper 180 to the material as discussed below.

Similarly, the second piece of material 120 is aligned on top of the fourth piece of material 140 with the finished surfaces of the second piece of material 120 and the fourth piece of material 140 facing outward. A second side 170*b* of the first zipper 170 then is attached along the first lateral side 120*a* of the second piece of material 120 and the first lateral side 140*a* of the fourth piece of material 140. In some implementations, the tape of the second side of the first zipper 170*b* is inserted between the second piece of material 120 and the fourth piece of material 140 along the first lateral side 120*a* of the second piece of material 120 and the first lateral side 140*a* of the fourth piece of material 140. In some implementations, the second side of the first zipper 170*b* does not extend all the way to the bottom 120*d*, 140*d* of the second piece of material 120 and the fourth piece of material 140 to, for example, provide space at the bottom of materials 120, 140, to attach the second zipper 180 to the material as discussed below.

The first lateral side 110*b* of the first piece of material 110 and the first lateral side 130*b* of the third piece of material 130 are aligned with the first lateral side 150*b* of the fifth piece of material 150. The second lateral side 120*c* of the second piece of material 120 and the second lateral side 140*c* of the fourth piece of material 140 are aligned with the second lateral side 150*b* of the fifth piece of material 150.

A first side 180*a* of a second zipper 180 (see FIG. 1A) then is sewn along the bottom side 150*d*, 110*d* and 130*d*, and 120*d* and 140*d* of the fifth piece of material 150, the layered first piece of material 110 and the third piece of material 130, and the layered second piece of material 120 and the fourth piece of material 140. In some implementations, the tape of the first side 180*a* of the second zipper 180 is inserted between the fifth piece of material 150 and the third piece of material 130 along the bottom side 150*d*, 130*d* of the fifth piece of material 150 and the third piece of material 130 and between the fifth piece of material 150 and the fourth piece of material 140 along the bottom side 150*d*, 140*d* of the fifth piece of material 150 and the fourth piece of material 140.

In some implementations, the second side of the second zipper 180*b* is attached along the bottom side 160*d* of the sixth piece of material 160.

The first lateral sides 110*b*, 130*b*, 150*b*, and 160*b* of the first, third, fifth, and sixth pieces of material are aligned and sewn together.

The second lateral sides 120*c*, 140*c*, 150*c*, and 160*c* of the second, fourth, fifth, and sixth pieces of material are aligned and sewn together.

The top sides 110*a*, 130*a*, 150*a* of the first, third, and fifth pieces of material are aligned and sewn to a portion of the top size 160*a* of the sixth piece of material 160.

The top sides 120*a*, 140*a*, 150*a* of the second, fourth, and fifth pieces of material are aligned and sewn to another portion of the top size 160*a* of the sixth piece of material 160.

Figure 1A:
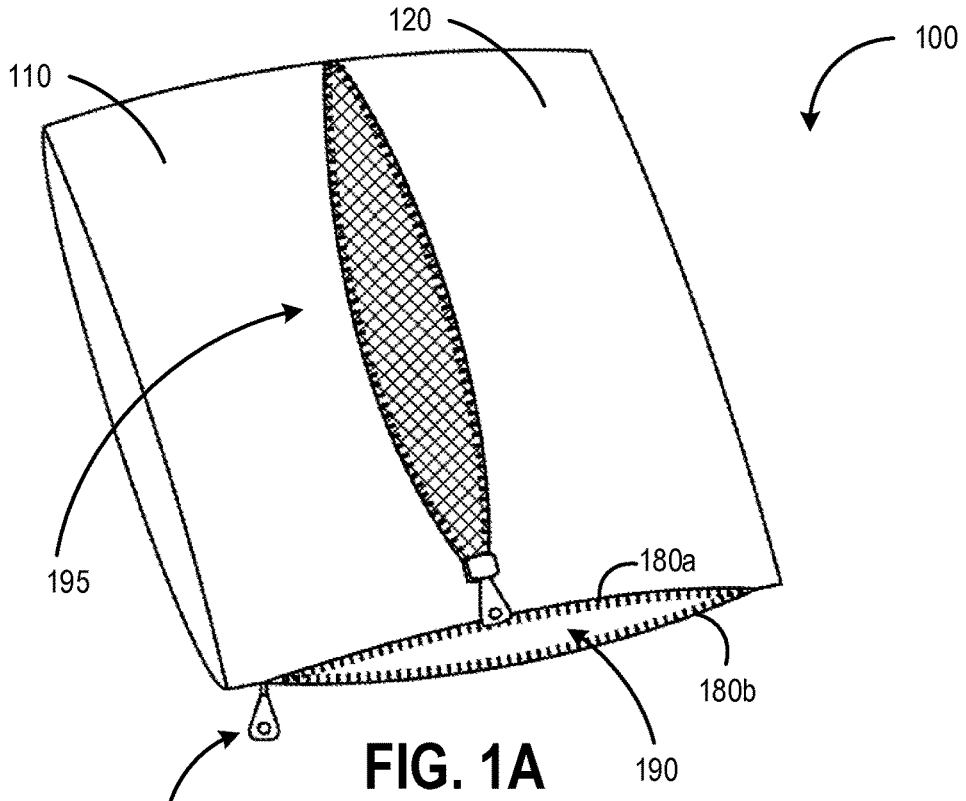
FIGS. 1A-1D and 2A-2D illustrate example configurations of a pillow cover according to the present disclosure.

Attaching the pieces of material as described above produces the pillow cover 100 illustrated in FIG. 1A. A pillow (not shown) may be inserted into the opening 190 at the bottom of the fifth piece of material 150 and the sixth piece of material 160. Once the pillow is inserted, the zipper 180 may be closed.

FIG. 1A illustrates a first configuration of the pillow cover 100 (before the zipper is closed). As shown in FIG. 1A, the design of the first 110 and second 120 pieces of material are viewable. Also, the design of the fifth piece of material 150 can be seen through the opening 195 between the second lateral sides 110*c*, 130*c* of the layered first 110 and third 130 pieces of material and the first lateral sides 120*b*, 140*b* of the layered second 120 and fourth 140 pieces of material. In this first configuration, the zipper 170 is in a fully opened position.

Figure 1B:
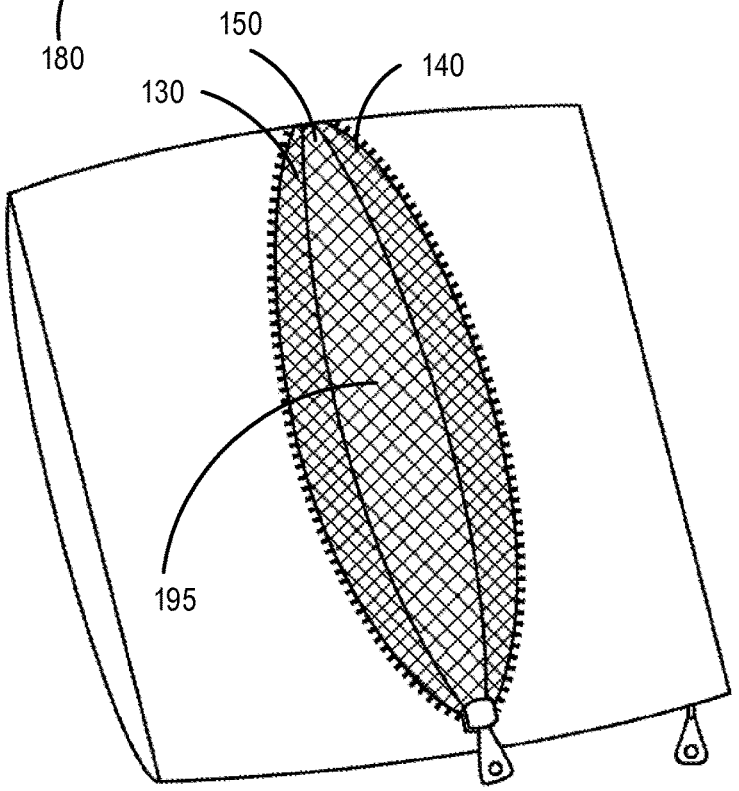

As shown in FIG. 1B, to achieve a second configuration of the pillow cover 100, the second lateral sides 110*c*, 130*c* of the layered first 110 and third 130 pieces of material may be flipped back on top of the first piece of material 110 to show a portion of the finished side of the third piece of material 130. Similarly, the first lateral sides 120*b*, 140*b* of the layered second 120 and fourth 140 pieces of material may be flipped back on top of the second piece of material 120 to show a portion of the finished side of the fourth piece of material 140. In this second configuration, the zipper 170 is in a fully opened position.

Figure 1C:
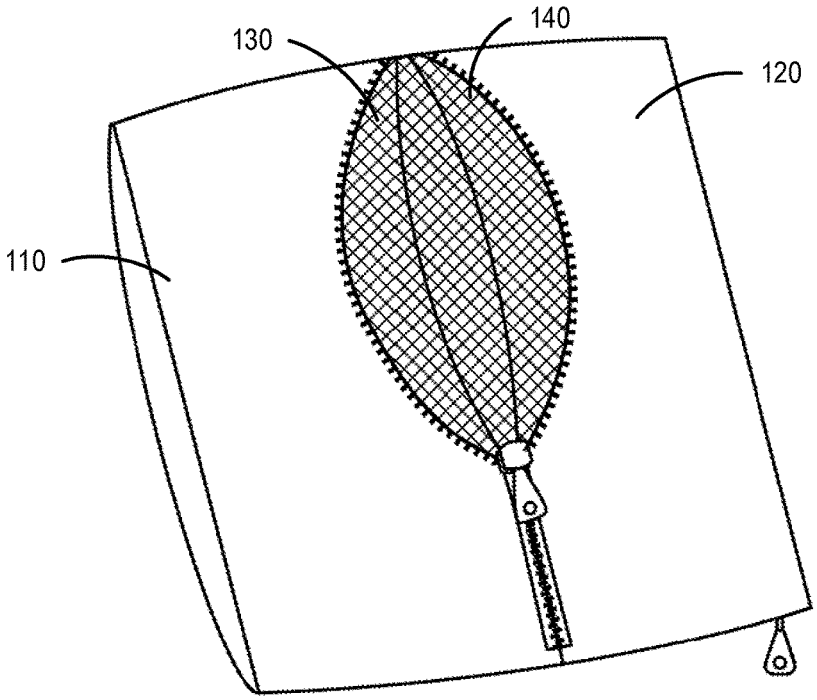

As shown in FIG. 1C, to achieve a third configuration of the pillow cover 100, the zipper 170 may be closed partially. In some implementations, the zipper 170 may be closed half-way. Numerous configurations can be achieved by positioning the zipper 170 in a number of positions between fully opened and fully closed.

Figure 1D:
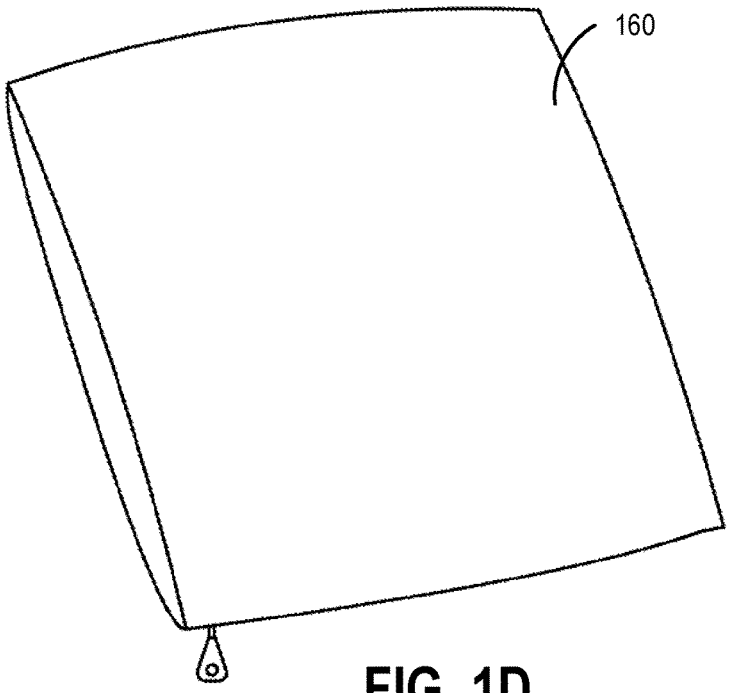

As shown in FIG. 1D, to achieve a fourth configuration of the pillow cover 100, the pillow cover 100 is flipped over to show the design of the sixth piece of material 160.

Figure 2A:
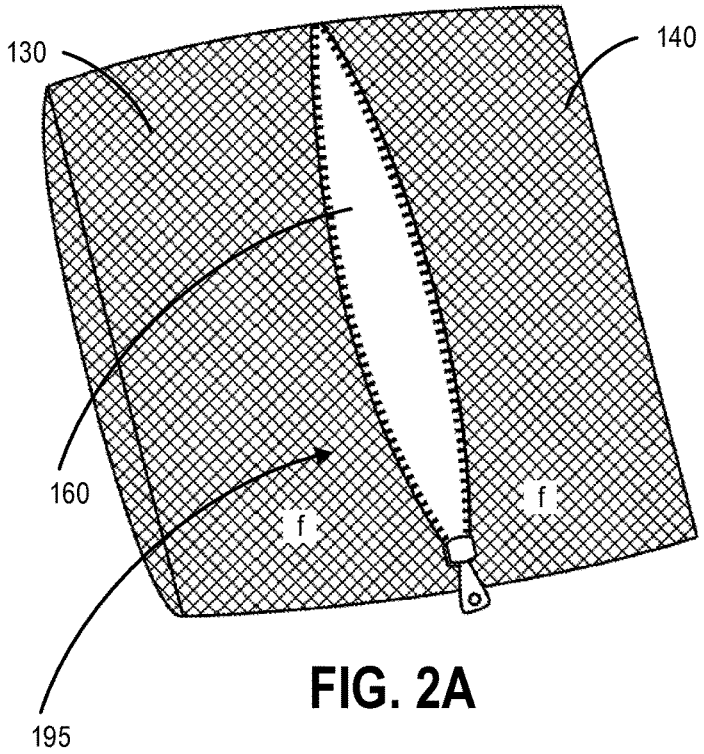

Referring to FIG. 1B, to achieved the fifth configuration of the pillow cover 100 shown in FIG. 2A, the second lateral sides 110*c*, 130*c* of the layered first 110 and third 130 pieces of material are flipped back on top of the first piece of material 110 (as shown in FIG. 1B) and pulled over the first piece of material 110 and around the first lateral side "b" of the pillow to the finished side of the sixth piece of material 160 as shown in FIG. 2A. Similarly, the first lateral sides 120*b*, 140*b* of the layered second 120 and fourth 140 pieces of material are be flipped back on top of the second piece of material 120 (as shown in FIG. 1B) and pulled over the second piece of material 120 and around the second lateral side "c" of the pillow to the finished side of the sixth piece of material 160 as shown in FIG. 2A. In some implementations, this may be achieved by also pushing the pillow cover through the opening 195.

As shown in FIG. 2A, the design of the third 130 and fourth 140 pieces of material are viewable. Also, the design of the sixth piece of material 160 can be seen through the opening 195 between the second lateral sides 130*c*, 110*c* of the layered third 130 and first 110 pieces of material and the first lateral sides 140*b*, 120*b* of the layered fourth 140 and second 120 pieces of material. In this fifth configuration, the zipper 170 is in a fully opened position.

Figure 2B:
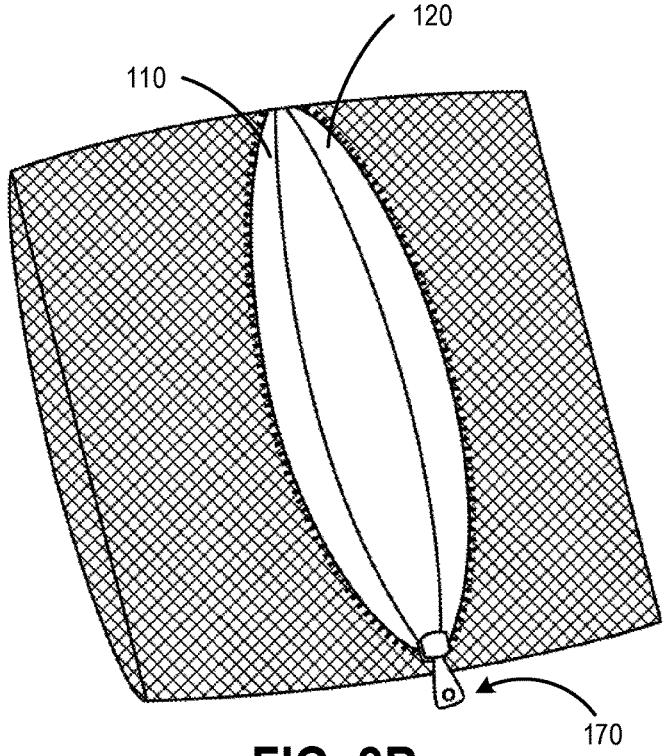

As shown in FIG. 2B, to achieve a sixth configuration of the pillow cover 100, the second lateral sides 130*c*, 110*c* of the layered third 130 and first 110 pieces of material may be flipped back on top of the third piece of material 130 to show a portion of the finished side of the first piece of material 110. Similarly, the first lateral sides 140*b*, 120*b* of the layered fourth 140 and second 120 pieces of material may be flipped back on top of the fourth piece of material 140 to show a portion of the finished side of the second piece of material 120. In this second configuration, the zipper 170 is in a fully opened position.

Figure 2C:
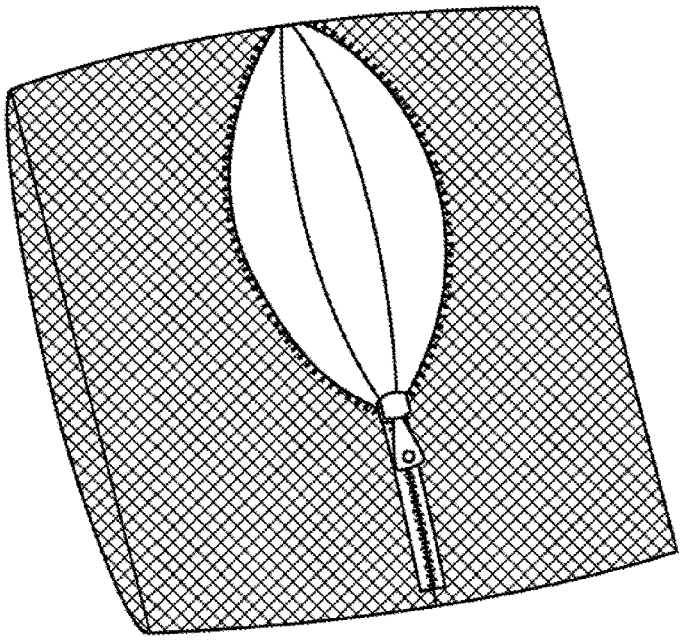

In some implementations, the zipper 170 may be reversible. In some implementations, the zipper 170 may be a double headed zipper. Accordingly, as shown in FIG. 2C, to achieve a seventh configuration of the pillow cover 100, the zipper 170 may be closed partially. In some implementations, the zipper 170 may be closed half-way. Numerous configurations can be achieved by positioning the zipper 170 in a number of positions between fully opened and fully closed.

Figure 2D:
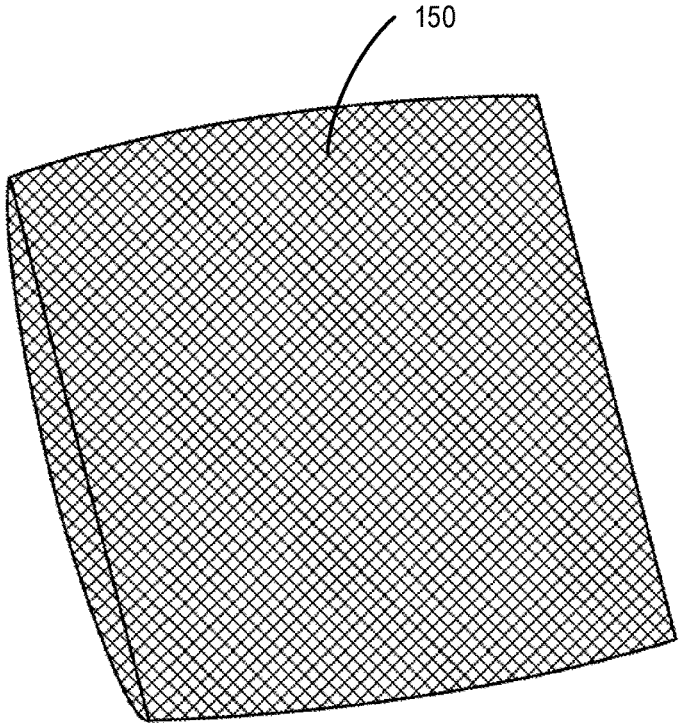

As shown in FIG. 2D, to achieve an eighth configuration of the pillow cover 100, the pillow cover 100 is flipped over to show the design of the fifth piece of material 150.

As shown in the figures, a single pillow according to the present disclosure cover can achieve at least eight different configurations and even more based on the placement of the zipper 170 by the end-user. The different configuration may be achieved without removing the pillow, if desired. However, the pillow can be removed from the pillow cover if desired.

Reference throughout this specification to "an embodiment" or "an implementation" or words of similar import means that a particular described feature, structure, or characteristic is included in at least one embodiment of the present invention. Thus, the phrase "in an embodiment" or "an implementation" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A pillow cover comprising:

a first piece of material, a second piece of material, a third piece of material, a fourth piece of material, a fifth piece of material, a sixth piece of material, a first reversible zipper; and a second zipper wherein:

each piece of material has a first surface and second surface wherein at least one surface is finished and each piece of material has a top side, a second lateral side opposite the first lateral side, and a bottom side;

wherein the fifth piece of material and the sixth piece of material have a square shape and are of equal size, and wherein and first piece of material, the second piece of material, the third piece of material, and the fourth piece of material, are all rectangularly shaped, and are sized to be half of the size of the fifth and sixth pieces of material;

the first piece of material is aligned on top of the third piece of material with the finished surfaces of the first piece of material and the third piece of material facing outward;

a first side of a first zipper is sewn along the second lateral side of the first piece of material and the second lateral side of the third piece of material;

the second piece of material is aligned on top of the fourth piece of material with the finished surfaces of the second piece of material and the fourth piece of material facing outward;

a second side of the first zipper then is attached along the first lateral side of the second piece of material and the first lateral side of the fourth piece of material;

the first lateral side of the first piece of material and the first lateral side of the third piece of material are aligned with the first lateral side of the fifth piece of material;

the second lateral side of the second piece of material and the second lateral side of the fourth piece of material are aligned with the second lateral side of the fifth piece of material;

a first side of a second zipper is sewn along the bottom side of the fifth piece of material, the layered first piece of material and the third piece of material, and the layered second piece of material and the fourth piece of material;

a second side of the second zipper is attached along the bottom side of the sixth piece of material so that the second zipper is oriented orthogonally to the first zipper;

the first lateral sides of the first, third, fifth, and sixth pieces of material are aligned and sewn together;

the second lateral sides of the second, fourth, fifth, and sixth pieces of material are aligned and sewn together;

the top sides of the first, third, and fifth pieces of material are aligned and sewn to a portion of the top size of the sixth piece of material;

the top sides of the second, fourth, and fifth pieces of material are aligned and sewn to another portion of the top size of the sixth piece of material;

the design of the finished surface of the first piece of material and the second piece of material are the same;

the design of the finished surface of the third piece of material and the fourth piece of material are the same and different than the design of the finished surface of the first piece of material and the second piece of material;

the design of the finished surface of the fifth piece of material is the same as the design of the finished surface of the third piece of material and the fourth piece of material; and the design of the finished surface of the sixth piece of material is the same as the design of the finished surface of the first piece of material and the second piece of material.

2. The pillow cover of claim 1 wherein the first piece of material, the second piece of material, and the sixth piece of material are cut from a larger material having a first design, the third piece of material, the fourth piece of material, and the fifth piece of material are cut from a larger material having a second design.

3. A method of configuring the pillow cover of claim 1, the method comprising:

inserting a pillow into the opening at the bottom of the fifth piece of material and the sixth piece of material; and closing the second zipper.

4. A method of configuring the pillow cover of claim 1, the method comprising:

flipping the second lateral sides of the layered first and third pieces of material back on top of the first piece of material to show a portion of the finished side of the third piece of material; and flipping the first lateral sides of the layered second and fourth pieces of material back on top of the second piece of material to show a portion of the finished side of the fourth piece of material.

5. A method of configuring the pillow cover of claim 1, the method comprising:

flipping the second lateral sides of the layered first and third pieces of material back on top of the first piece of material and pulling the second lateral sides of the layered first and third pieces of material over the first piece of material around the first lateral side of the pillow to the finished side of the sixth piece of material; and flipping the first lateral sides of the layered second and fourth pieces of material back on top of the second piece of material and pulling the first lateral sides of the layered second and fourth pieces of material over the second piece of material and around the second lateral side of the pillow to the finished side of the sixth piece of material.

6. A method of configuring the pillow cover of claim 1, the method of claim 4 further comprising:

flipping the second lateral sides of the layered third and first pieces of material back on top of the third piece of material to show a portion of the finished side of the first piece of material; and flipping the first lateral sides of the layered fourth and second pieces of material back on top of the fourth piece of material to show a portion of the finished side of the second piece of material.

7. A pillow cover comprising:

a first piece of material, a second piece of material, a third piece of material, a fourth piece of material, a fifth piece of material, a sixth piece of material, a first reversible zipper; and a second zipper wherein:

each piece of material has a first surface and second surface wherein at least one surface is finished and each piece of material has a top side, a second lateral side opposite the first lateral side, and a bottom side;

wherein the fifth piece of material and the sixth piece of material have a square shape and are of equal size, and wherein and first piece of material, the second piece of material, the third piece of material, and the fourth piece of material, are all rectangularly shaped, and are sized to be half of the size of the fifth and sixth pieces of material;

the first piece of material is aligned on top of the third piece of material with the finished surfaces of the first piece of material and the third piece of material facing outward;

a first side of a first zipper is sewn along the second lateral side of the first piece of material and the second lateral side of the third piece of material;

the second piece of material is aligned on top of the fourth piece of material with the finished surfaces of the second piece of material and the fourth piece of material facing outward;

a second side of the first zipper then is attached along the first lateral side of the second piece of material and the first lateral side of the fourth piece of material;

the first lateral side of the first piece of material and the first lateral side of the third piece of material are aligned with the first lateral side of the fifth piece of material;

the second lateral side of the second piece of material and the second lateral side of the fourth piece of material are aligned with the second lateral side of the fifth piece of material;

a first side of a second zipper is sewn along the bottom side of the fifth piece of material, the layered first piece of material and the third piece of material, and the layered second piece of material and the fourth piece of material;

a second side of the second zipper is attached along the bottom side of the sixth piece of material so that the second zipper is oriented orthogonally to the first zipper;

the first lateral sides of the first, third, fifth, and sixth pieces of material are aligned and sewn together;

the second lateral sides of the second, fourth, fifth, and sixth pieces of material are aligned and sewn together;

the top sides of the first, third, and fifth pieces of material are aligned and sewn to a portion of the top size of the sixth piece of material;

the top sides of the second, fourth, and fifth pieces of material are aligned and sewn to another portion of the top size of the sixth piece of material.

* * * * *